US012016439B2

(12) United States Patent
Lagandré

(10) Patent No.: US 12,016,439 B2
(45) Date of Patent: Jun. 25, 2024

(54) RETRACTABLE DEVICE FOR PROTECTING THE HEAD OF A USER AGAINST BAD WEATHER

(71) Applicant: Pierre Lagandré, Castelnau le Lez (FR)

(72) Inventor: Pierre Lagandré, Castelnau le Lez (FR)

( * ) Notice: Subject to any disclaimer, the term of this patent is extended or adjusted under 35 U.S.C. 154(b) by 47 days.

(21) Appl. No.: 17/043,265

(22) PCT Filed: May 6, 2019

(86) PCT No.: PCT/FR2019/051037
§ 371 (c)(1),
(2) Date: Sep. 29, 2020

(87) PCT Pub. No.: WO2019/211571
PCT Pub. Date: Nov. 7, 2019

(65) Prior Publication Data

US 2021/0015222 A1 Jan. 21, 2021

(30) Foreign Application Priority Data

May 4, 2018 (FR) ..... 1853890

(51) Int. Cl.
*A45B 11/04* (2006.01)
*A42B 1/201* (2021.01)

(52) U.S. Cl.
CPC ..... *A45B 11/04* (2013.01); *A42B 1/201* (2013.01)

(58) Field of Classification Search
CPC ..... A45B 11/02; A42B 1/201; A42B 3/322; A45F 4/12; A45F 2300/003
(Continued)

(56) References Cited

U.S. PATENT DOCUMENTS 1,092,794 A 4/1914 Hughes-Mahone
1,803,538 A 5/1931 Pistole
(Continued)

FOREIGN PATENT DOCUMENTS

EP 1633214 B1 3/2008
JP 6196005 B1 9/2017
(Continued)

OTHER PUBLICATIONS

ISR; European Patent Office, NL; Aug. 7, 2019.

*Primary Examiner* — Katherine M Moran
*Assistant Examiner* — Grady Alexander Nunnery
(74) *Attorney, Agent, or Firm* — Patshegen IP; Moshe Pinchas

(57) ABSTRACT

A retractable protection device for protecting a user's head against environmental elements, the device includes at least one hoop, at least two articulations of at least one hoop with a base, each articulation being attached to one end of at least one hoop, at least one articulation comprising a means for locking said hoop in a predefined position referred to as the "deployed position". The device further includes at least partially closed base, configured to surround the user's nape at least partially, and a sheet of fabric attached to each hoop and the base to create a protection screen around the user's head in the deployed position, the fabric and hoops being circumscribed by the base in a position referred to as the "folded position" that minimizes the size of the device, between the user's nape and shoulders, freeing up the user's back.

15 Claims, 6 Drawing Sheets

(58) Field of Classification Search
USPC ..... 135/16
See application file for complete search history.

(56) References Cited

U.S. PATENT DOCUMENTS

| | | | | |
|---|---|---|---|---|
| 4,291,417 | A | 9/1981 | Pagano | |
| 5,896,590 | A * | 4/1999 | Fleisch | A42B 3/322 224/186 |
| 6,024,264 | A | 8/2000 | Java | |
| 8,556,141 | B1 * | 10/2013 | Ferraiolo | A45B 17/00 224/186 |
| 8,690,031 | B1 | 4/2014 | Blakley | |
| 8,944,300 | B1 * | 2/2015 | Kaufman | A45B 11/02 224/628 |
| 2005/0027939 | A1 | 12/2005 | Choi | |
| 2005/0279396 | A1 * | 12/2005 | Choi | A45B 11/04 135/133 |
| 2006/0143795 | A1 | 7/2006 | London | |
| 2010/0078457 | A1 * | 4/2010 | Pitchford | A42B 1/048 2/84 |
| 2013/0098410 | A1 * | 4/2013 | Prasannakumar | A45B 11/00 135/16 |
| 2015/0089711 | A1 | 4/2015 | Gibson, Jr. | |

FOREIGN PATENT DOCUMENTS

| | | | |
|---|---|---|---|
| WO | 9622033 | A1 | 7/1996 |
| WO | 2006105340 | A2 | 10/2006 |

* cited by examiner

RETRACTABLE DEVICE FOR PROTECTING THE HEAD OF A USER AGAINST BAD WEATHER

TECHNICAL FIELD OF THE INVENTION

The present invention relates to a retractable protection device. It applies, in particular, to protecting a user's head from environmental or weather elements such as the sun, rain, wind or pollution.

STATE OF THE ART

Hoods are a well-known means for protecting a user's head from becoming wet in the rain. A hood or cap is a clothing accessory which is used to protect a user's head from the rain, sun and wind, while leaving hands free. When not in use, it is either folded into the collar of the garment, or hangs unfolded at the back of the garment. Current hoods are not very practical when they touch the head, mess up the hair, fall over the forehead or eyes, boosting perspiration, as poorly ventilated.

Another well-known device is the umbrella. The umbrella or parasol is better protection from rain or sun than the hood, and the head is better ventilated. However, the need to hold it with one hand limits the practicality of these arrangements since two free hands are required for some actions, such as telephoning, reading a map, riding a bicycle, pushing a pushchair or trolley, clapping at a show or match, or carrying out manual work, for example.

Other umbrella-holder types of accessory to be fixed onto the backpack, bike or pushchair have limited utility and effectiveness. In addition, the sensitivity of umbrellas and parasols to gusts of wind is a recognized drawback.

Hats, caps, sunhats and other headgear can provide effective protection from the sun and rain but are sensitive to the wind. One keeps the use of both hands, but the head perspires and the hairstyle is not preserved.

The main criticisms against rain protection equipment are, in descending order of importance, that they block the view, provide only partial protection, have no ventilation for the head, and are very sensitive to wind.

The main criticisms against sun protection equipment are, in descending order of importance, that they are very sensitive to wind, have no ventilation for the head, provide only partial protection, and mess up the hair.

The U.S. Pat. No. 8,944,300 by the company Nubrella is known, which discloses a rain protection device having hoops articulated around the user's shoulders and a base on the user's back. The user's movements are hampered by the size of the device and the location of the base, which is heavy. Once folded, the hoops rest on the back in an unwieldy position.

The American patent application US 2005/0 279 396 is also known, which has a sunshade in the form of a retractable hood fixed around a user's body by a harness. The device described has very low rigidity and extremely poor stability once worn by the user, making the device unusable in wind or for walking fast.

U.S. Pat. No. 5,896,590 discloses a device that deploys automatically around a user's head in the event of a fall when riding a horse. Hoops and fabric are contained in a backpack and folded on the user's back before deployment.

U.S. Pat. No. 1,803,538 discloses retractable cap whose hoops are arranged on a user's back in the folded position.

U.S. Pat. No. 8,690,031 discloses a back harness that comprises a hood equipped with hoops. In the folded position, the hood is vertical above the user's shoulders.

American patent application US 2015/089711 discloses a device which, once folded, rests on the user's back.

SUBJECT OF THE INVENTION

The present invention aims to remedy all or part of these drawbacks.

To this end, according to a first aspect, the present invention envisages a retractable protection device for protecting a user's head from environmental elements, which comprises:

- at least one hoop;
- at least two articulations of at least one hoop with a base, each articulation being attached to one end of at least one hoop, at least one articulation comprising a means for locking said hoop in a predefined position referred to as the "deployed position";
- an at least partially closed base, configured to surround the user's nape at least partially, comprising:
  - at least one support resting on each shoulder of the user; and
  - at least one spreader for positioning each articulation at a predefined distance from each support in the deployed position;
- a sheet of fabric attached to each hoop and the base to create a protection screen around the user's head in the deployed position, the fabric and hoops being circumscribed by the base in a position referred to as the "folded position" that minimizes the size of the device, between the user's nape and shoulders, freeing up the user's back.

The device is an item of equipment that is a cross between an umbrella and a hood, which makes it possible to have the head ventilated and to retain the use of both hands while being protected from the sun, rain and wind. The surface of protection is smaller than that of an umbrella but larger than that of a hood, hat or cap. The device can be easily and quickly unfolded or folded away, and the device is compact once folded. The device resists gusts of wind thanks to the hoops and the locking means.

The hoops make it possible to obtain a larger surface of protection, but without the fabric sagging and touching the user's hair or head. The articulations allow the fabric to be deployed or to be folded away when protection is no longer needed. The purpose of the spreader is to raise the two articulations up to the approximate height of the user's ears, which allows the fabric sheet and hoops to be deployed around the user's head without touching it, while keeping the hoops at a compact size, and thus able to be positioned around the user's neck in the folded position.

The device that is the subject of the present invention also carries out the following functions:

- protecting and ventilating the user's head thanks to the hoops and spreaders;
- preserving the user's view and freedom of movement, in particular of the head, hands and shoulders, thanks to the supports and the shape of the hoops;
- preserving the perception of external noises, because the fabric does not rub against the user's head and ears unlike a hood;
- having a pleasing appearance that enhances the user;
- being waterproof, breathable, resistant to ultraviolet and/or certain chemical agents such as pollution, toxic paint dust, or other chemical products, and to impacts;

being borne by the user;

being easy to deploy and fold away; and/or being light, compact and protected once folded.

In addition, the base comprises each spreader, and each support makes it possible to give the device structural rigidity. The device better resists forces such as wind, and the forces for deploying the hoops and the fabric. The device is also more stable under the impacts of each step when the user is walking. In addition; since the fabric is at least partially attached to the base, the base enables the fabric to be extended and kept above the user's head. This arrangement also makes it possible to dispense with a rear hoop, which simplifies the design of the articulations since they are only connected to a single hoop. The base and fabric transfer the forces evenly on the user's shoulders, making the user's activity more agreeable.

Lastly, when the device is in the folded position, the hoops and fabric are protected from impacts and projections by the support plate, and an aesthetic appearance is respected.

In some embodiments, the device that is the subject of the present invention comprises a means for keeping hoops in the folded position.

These embodiments make it possible to prevent the inadvertent deployment of the device.

In some embodiments, the retention means has a pocket fitted with a closure means attached to at least one fastener attaching the fabric to the base, the pocket being positioned in the base.

These embodiments mean each hoop and the fabric can be folded away inside the base. Therefore, in the folded position, the hoops provide increased rigidity for the base. In addition, in the deployed position, the closure means attached to at least one fastener attaching the fabric also increases the rigidity of the device through the extra thickness formed. The pocket has at least one rainwater evacuation device, such as a hole in its outer wall, for example.

In some embodiments, at least one spreader comprises at least two arcs, each support and each articulation being attached to the end of an arc.

Thanks to these provisions, each spreader can be made of fabric and have a very low weight for greater comfort for the user.

In some embodiments, at least one spreader comprises two struts articulated by a toothed rotation means at one end, the other end of one strut being attached to one support on one side of the user's head, the other end of the other strut being attached to one articulation on the same side of the user's head.

These embodiments make it possible to adjust the height of the spreader and adapt it to the user's morphology thanks to different teeth. In addition, the device remains very compact.

In some embodiments, the arcs cross and are assembled by means of a toothed assembly.

Thanks to these provisions, the assembly has increased rigidity, in particular for resisting the wind. And the distance between the supports and the articulations can be adjusted for several positions.

In some embodiments, one arc is attached to each support and one arc is attached to each articulation, the arcs being tangential to the middle of each arc.

These embodiments make it possible to facilitate the manufacture of the device so that the arcs can be positioned attached to the fabric independently.

In some embodiments, at least one spreader comprises at least one triangulation spacing means between the two arcs for separating the ends of one arc from the ends of the other arc.

The advantage of these embodiments is that they have a number of positions not limited to the number of teeth of a toothed mechanism, and a separation movement along a straight line.

In some embodiments, at least one spreader comprises at least one deformable part tangential to one end of one arc and one end of the other arc.

Thanks to these provisions, the articulations are deployed automatically once the arc retention means is removed.

In some embodiments, at least one spreader comprises one portion attached to the articulations and one foldable portion comprising the supports.

The advantage of these embodiments is that they make it possible to limit the height of the device in the folded position.

In some embodiments, the fabric comprises a cape for protecting at least the user's shoulders.

Thanks to these provisions, the user's clothes and clothing accessories are also protected. In particular, the cape makes it possible to protect a backpack, if there is one, and also prevent the rain from falling between the user's back and the backpack. Especially since the portion of the backpack facing a user's back is not watertight. The cape means that the user does not have to wear a large rain cape, such as a poncho, and can keep his rain jacket, which is important, especially when hiking.

In some embodiments, the device that is the subject of the present invention comprises means for attaching the device to clothing or a clothing accessory.

These embodiments allow the device to be adapted to any clothing or clothing accessory.

In some embodiments, the device that is the subject of the present invention comprises a cap attached to at least one hoop.

These embodiments allow the protection of the user's face to be increased.

In some embodiments, the articulation comprises a means for attaching at least one accessory.

These embodiments allow additional hoops to be attached, for example.

In some embodiments, each arc has a helical shape, and each arc is attached to an articulation intended to be placed on one size of the user's head, and to a support intended to be placed on the user's shoulder on the other side of the head.

The advantage of these embodiments is an automatic deployment of each spreader to raise the articulations. In addition, folding each spreader is made easier because it is just necessary to flatten the arcs and then keep them in position.

In some embodiments, the arcs are assembled by means of a toothed pivoting connection in the middle of each arc.

Thanks to these provisions, assembly is simpler because it only comprises a single pivot for the two arcs. And the distance between the supports and the articulations can be adjusted for several positions.

In some embodiments, at least one spreader comprises at least one V-spring close to the articulation or the middle of the arcs.

Thanks to these provisions, the articulations are deployed automatically once the arc retention means is removed.

In some embodiments, at least one spreader comprises at least two sliding parts, a first part being attached to the supports and a second part being attached to the articulations.

These embodiments make it possible to obtain different distances between the supports and articulations while maintaining rigidity for each spreader.

BRIEF DESCRIPTION OF THE FIGURES

Other advantages, aims and particular features of the invention will become apparent from the non-limiting description that follows of at least one particular embodiment of the device that is the subject of the present invention, with reference to drawings included in an appendix, wherein.

DESCRIPTION OF EXAMPLES OF REALIZATION OF THE INVENTION

The present description is given in a non-limiting way, each characteristic of an embodiment being able to be combined with any other characteristic of any other embodiment in an advantageous way.

It is now noted that the figures are not to scale.

It is noted that the shoulder is the morphological area located at the junction of the torso with the upper limb, extending from the neck to the junction with the arm.

Figure 1:
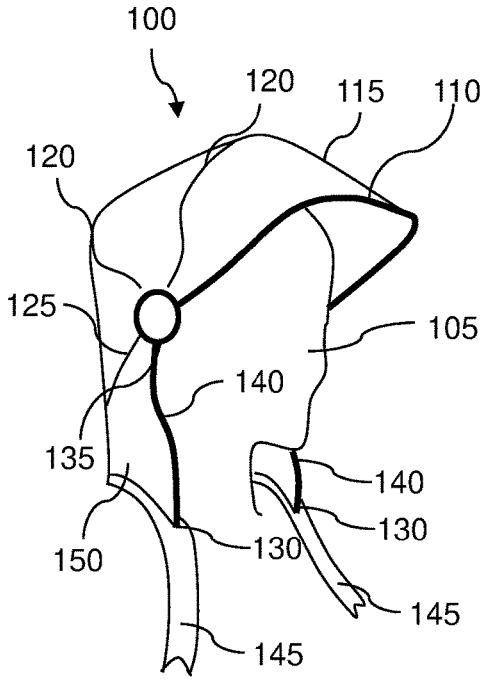
FIG. 1 represents, schematically, a first particular embodiment of the device that is the subject of the present invention in the deployed position.

FIG. 1, which is not to scale, shows a schematic view of an embodiment of the device 100 that is the subject of the present invention.

The retractable protection device 100 for protecting a user's head from environmental elements comprises:

- at least one hoop 110;
- at least two articulations 135 of at least one hoop 110 with a base 150, each articulation being attached to one end of at least one hoop 110, at least one articulation 135 comprising a means for locking said hoop in a predefined position referred to as the "deployed position";
- an at least partially closed base 150, configured to surround the user's nape at least partially, comprising:
  - at least one support 130 resting on each shoulder of the user; and
  - at least one spreader 140 for positioning each articulation 135 at a predefined distance from each support 130 in the deployed position;
- a sheet of fabric 115 attached to each hoop, 110 and 120, and the base 150 to create a protection screen around the user's head in the deployed position, the fabric 115 and hoops, 110 and 120, being circumscribed by the base in a position referred to as the "folded position" that minimizes the size of the device, between the user's nape and shoulders, freeing up the user's back.

In the folded position, the ends of the hoops are stacked at the location of the spreaders, which rest on the user between the user's nape and shoulders, for example on the user's trapezius muscle.

The protection device 100 comprises one hoop 125, referred to as the "rear hoop", positioned behind the user's head 105 in the deployed position. The protection device 100 comprises one hoop 110, referred to as the "front hoop", positioned above and in front of the user's face in the deployed position.

In the embodiment shown in FIG. 1, the device comprises two hoops 120, referred to as "middle hoops", between the front hoop 110 and the rear hoop 125 in the deployed position. Preferably, the device 100 comprises about eight middle hoops 120.

Preferably, the dimensions of each middle hoop 120 are identical and, notably in cross-section, smaller than the dimensions of the front hoop, 110. These embodiments allow the device to be made lighter in respect of the middle hoops; only the front hoop is structural and has greater dimensions to withstand the various forces. For example, the middle hoops are rods having a circular cross-section with a diameter between one and three millimeters, and the front hoop is a rod having a circular cross-section with a diameter between three and six millimeters.

In some embodiments, at least two hoops are structural.

One hoop, 110, 120 or 125, is a bar, or a rod. The hoop, 110, 120 or 125, has, for example, a circular or oblong cross-section, such as an ellipse. The circular cross-section can be hollow to reduce the weight of the device 100.

Preferably, the hoops, 110, 120 and 125, are made of a polymer material, such as polyamide or polypropylene, a composite material incorporating carbon fiber, glass fiber or flax fiber, or a metallic material, for example.

Figure 17:
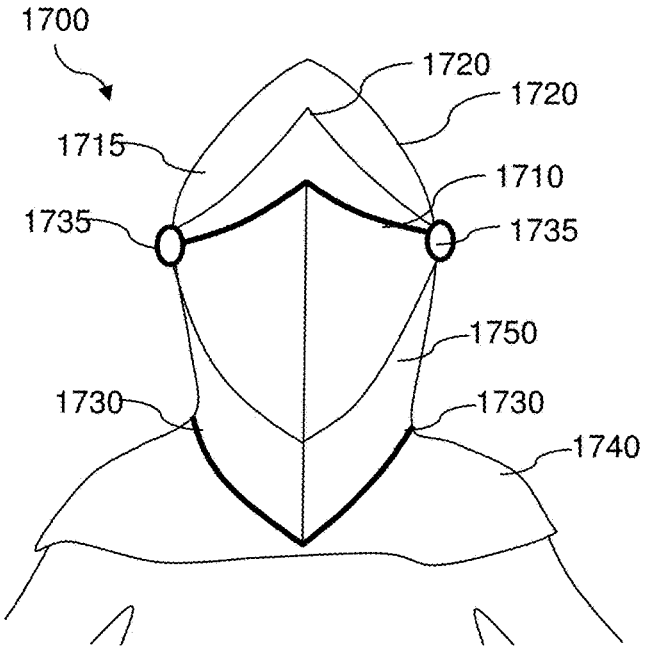
FIG. 17 represents, schematically, a sixteenth particular embodiment of the device that is the subject of the present invention.

In some embodiments, the hoops, 110, 120 and 125, have an arched V shape, as shown in FIG. 17, for example, to cover the user's forehead and free up the visual space on both sides of the user's head.

More generally, the hoops, 110, 120 and 125, can have an axially symmetrical shape such that the axis of symmetry is positioned substantially in the middle of the user's forehead. The axially symmetrical shape has an apex on the axis of symmetry such that, in the deployed position, the apex is farther forward relative to the plane of the forehead than the ends.

Preferably, the front hoop is made of polyamide with a diameter between three and six millimeters. Preferably, each middle hoop is made of polypropylene with a diameter between one and three millimeters.

The front hoop 110 and the rear hoop 125 are attached to an articulation 135. The articulation 135 forms a pivoting connection between the hoops. Preferably, the articulation 135 forms a pivoting connection between each hoop, 110 and 125, and a spreader 140.

In some embodiments, the articulation 135 has the form of two disks having the same center and the same diameter, each disk having an attachment hole for fastening one end of the hoop, 110, 120 or 125. Each disk also has a shoulder along the periphery of the disk, one shoulder having a smaller circumference than the other shoulder and the shoulders being embedded and in contact to form a pivoting connection. The rotation of the pivoting connection is limited by the tension of the fabric 115 attached to the front 110 and rear 125 hoops.

Each articulation 135 comprises a locking means. The locking means can be any locking means known to the person skilled in the art, such as the insertion of a retractable pin into a corresponding hole, for example. The locking means can be released by means of a push-button, for example.

Preferably, the articulation 135 comprises a system of teeth, blocking the rotation of the articulation 135. For example, at least one shoulder comprises a set of teeth and the other shoulder comprises at least one tooth with a shape matching the hollow between two teeth of the other shoulder. The rotation of one disk relative to the other results in the elastic deformation of one tooth and each hollow corresponds to one position. The set of teeth forms the means for locking the articulation 135.

In some embodiments, the articulation 135 comprises a return spring in the deployed position.

In some embodiments, each articulation 135 comprises:

- at least two fasteners for fastening to the base 150, the fasteners forming a pivoting connection axis;
- one part, mobile in rotation around the pivoting connection axis, comprising a longitudinal hole matching the shape of the end of a hoop 110, in which the end of at least one hoop 110 is placed, and having an axis perpendicular to the pivoting connection axis.

In some embodiments, the articulation 135 comprises an attachment hole for attaching an end of each middle hoop 120. Preferably, the hoops, 110, 120 and 125, are attached by embedding one end of the hoop, 110, 120 or 125, in an attachment hole and possibly glued or soldered.

The articulation 135 can be formed of any rotating articulation comprising a locking means known to the person skilled in the art.

Preferably, one articulation 135 is located at one of the user's ears, and the other articulation 135 is at the level of the user's other ear in the deployed position.

In some embodiments (not shown), the articulation 135 is equipped with a cord connected to the front hoop 110. By pulling on the cord, the user deploys the front hoop 110 above the user's head to the desired position. A specific part located on the base, for example on the element 145 or on the support 130, allows the cord to be locked once the fabric is taut. This part also makes it possible to adjust the tension of the fabric.

In some embodiments, the articulation comprises a means for attaching at least one accessory. For example, the articulation 135 is hollowed out at the location of the axis of rotation of the articulation 135. The cut-out allows an accessory to be inserted, for example an additional middle hoop such as the hoop 1660 shown in FIG. 16, or an electronic device.

In the embodiment shown in FIG. 1, the base 150 comprises a piece of material or fabric 145 attached to an item of clothing or a clothing accessory. The piece of material or fabric 145 can be lined with foam to protect the user's shoulders. In the folded position, the fabric 115 and the hoops, 110, 120 and 125, are circumscribed by the base in a folded position, i.e. the fabric 115 and the hoops, 110, 120 and 125, are between the user's nape and the base, between the user's shoulders and nape.

Preferably, the base 150 is at least partially rigid and its arc length is greater than the length of each hoop, 110, 120 and 125, so that the hoops fold away on the inside of the base. The inside of the base is defined as the surface of the base next to the user's nape.

The spreader 140 comprises two struts, one end of one of the struts being attached to one articulation 135 and one end of the other strut being attached to the support 130. The other ends of the struts have complementary reliefs for embedding the ends of the struts and form an extension. To fold the device 100, the reliefs are disengaged and the struts are folded one on top of the other.

It is noted here that the strut is a rigid rod, articulated at its ends and intended to transmit movement between two moving parts, in this case the supports 130 and the articulations 135.

The base 150 also comprises a piece of fabric between the rear hoop 125, the supports 130 and the articulations 135 to protect the user's nape from bad weather and environmental elements.

The fabric 115 and/or the fabric of the base 150 are preferably made of a material resistant to impacts, tears and ultraviolet, such as polyester, polypropylene, or polyamide. In some embodiments, the fabric 115 and the fabric of the base 150 form a single piece of cloth.

In some embodiments, the fabric 115 and/or the fabric of the base 150 are made of an impermeable material.

In some embodiments, the fabric 115 and/or the fabric of the base 150 are made of a lined material to protect the user from the cold. In some embodiments, the fabric 115 comprises at least one portion made of a material reflecting light or incorporating a light device so that the user is more visible in the dark, especially when the device 100 is lit up by headlights. In some embodiments, the fabric 115 is made of a transparent material.

Preferably, the supports 130 are part of a base 150 forming a collar resting around the user's nape and shoulders. The fabric of the spreader 140 is attached to the collar and the supports are located on the collar.

In some embodiments, the base 150 comprises an attachment means configured to:

- attach the device 100 to at least one backpack strap, for example the attachment means is a hook-and-loop fastener type of material positioned around the backpack strap;
- attach the device 100 to a harness or a holster; and/or
- attach the device 100 to an item of clothing or a clothing accessory, for example by means of clips or press-studs.

In some embodiments, the device 100 comprises a harness (not shown). The harness can comprise two adjustable straps that pass under the user's arms. In some embodiments, the harness comprises an adjustable strap slung over the shoulder. In some embodiments, the harness is in the form of a holster or vest. In some embodiments, the harness comprises shoulder straps that are ten to thirty millimeters thick. In some embodiments, the harness comprises a piece of fabric comprising press-studs or hook-and-loop fastener strips to be attached to an item of clothing or a clothing accessory. The item of clothing or clothing accessory can comprise additional attachment means.

Figure 2:
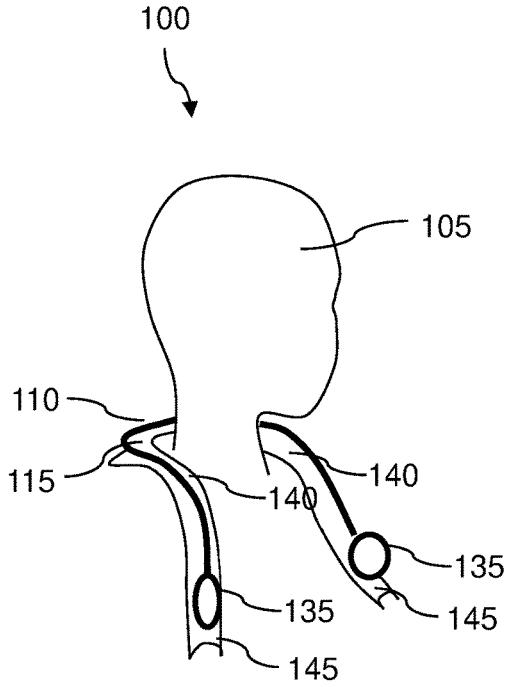
FIG. 2 represents, schematically, a first particular embodiment of the device that is the subject of the present invention in the folded position.

FIG. 2 shows the first embodiment of the device 100 that is the subject of the present invention in the folded position.

The hoops, 110, 120 and 125, and the fabric 115 are folded at the location of the user's nape, and the struts and fabric of the spreader 140 are folded and positioned around the user's nape along the hoops thus positioned on the base 150. The device 100 occupies very little space.

FIGS. 3 to 14 show different embodiments of the device. In the embodiments shown, the fabric and the base are not shown and the hoops, articulations and supports has similar characteristics to those defined with regard to FIG. 1. FIGS. 3 to 14 show different embodiments of spreaders.

Figure 3:
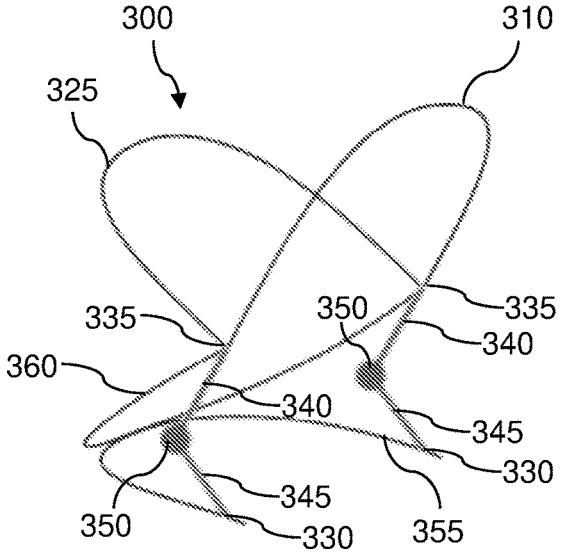
FIG. 3 represents, schematically, a second particular embodiment of the device that is the subject of the present invention.

In the embodiment shown in FIG. 3, at least one spreader of the device 300 comprises at least two arcs, 355 and 360, each support 330 and each articulation 335 being attached to the end of an arc.

Preferably, one arc 355 is attached to each support 330 and one arc 360 is attached to each articulation 335, the arcs being tangential to the middle of each arc, 355 and 360.

The 'middle of each arc, 355 and 360', means here a portion of at least ten percent of the length of each arc, 355 and 360, around the middle of each arc 355 and 360.

Preferably, the arcs, 355 and 360, have the same shape and the same dimensions.

One arc, 355 or 360, is a bar, or a rod. The arc, 355 or 360, preferably has a circular or elliptical cross-section. The cross-section can be hollow.

In the embodiment shown in FIG. 3, at least one spreader comprises two struts, 340 and 345, articulated by a toothed rotation means 350 at one end, the other end of one strut 340 being attached to one support 330 on one side of the user's head, the other end of the other strut 345 being attached to one articulation 335 on the same side of the user's head.

The toothed rotation means forms a pivoting connection between the struts 340 and 345 whose positions are predefined by teeth. Preferably, the toothed rotation means is located between the arcs, 355 and 360, to limit the size of the spreader. The toothed rotation means produces a pivoting connection along an axis perpendicular to a plane defined by a support 330 and an articulation configured to be placed on the same side of the user's head.

In some embodiments, one rotation means 350 comprises teeth, the other rotation means 350 being just a pivoting connection.

The axes of the pivoting connections produced by the rotation means are one and the same.

Preferably, the fabric (not shown) covering the hoops, 310 and 325, covers the arcs, 355 and 360, as well.

Figure 4:
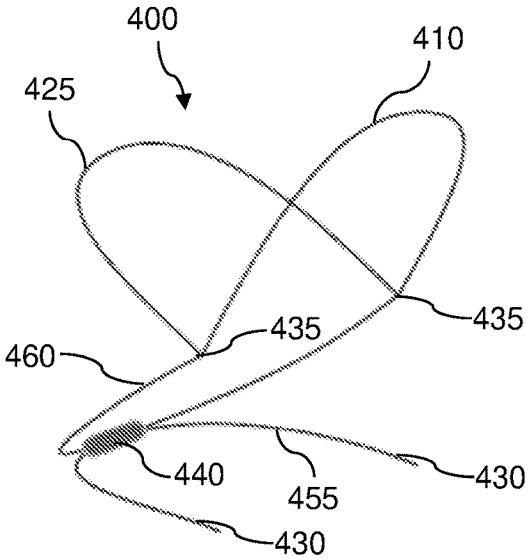
FIG. 4 represents, schematically, a third particular embodiment of the device that is the subject of this invention.

In the embodiment shown in FIG. 4, at least one spreader of the device 400 comprises at least two arcs, 455 and 460, each support 430 and each articulation 435 being attached to the end of an arc.

Preferably, one arc 455 is attached to each support 430 and one arc 460 is attached to each articulation 435, the arcs being tangential to the middle of each arc, 455 and 460.

The 'middle of each arc, 455 and 460', means here a portion of at least ten percent of the length of each arc, 455 and 460, around the middle of each arc 455 and 460.

Preferably, the arcs, 455 and 460, have the same shape and the same dimensions.

One arc, 455 or 460, is a bar, or a rod. The arc, 455 or 460, preferably has a circular or elliptical cross-section. The cross-section can be hollow.

In the embodiment shown in FIG. 4, the arcs, 455 and 460, are assembled by means of a toothed pivoting connection 440 in the middle of each arc, 455 and 460. The toothed pivoting connection 440 is in the axis of the arcs, 455 and 460. The axis of the arc, 455 or 460, is defined by the curve connecting the middle of each transversal section of the arc, 455 and 460. The pivoting connection has an axis parallel to the axis of the arcs, 455 and 460.

The toothed pivoting connection 440 is such that the ends of the arcs, 455 and 460, are spaced when a rotation between the arcs, 455 and 460, is engaged. Since the arc 455 is attached to the support 430 and the arc 460 is attached to the articulations 435, the rotation moves the articulations 435 away from the supports 430. The toothed pivoting connection comprises at least two teeth, each tooth representing a predefined position of the arcs, 455 and 460.

Preferably, the fabric (not shown) covering the hoops, 410 and 425, covers the arcs, 455 and 460, as well.

Figure 5:
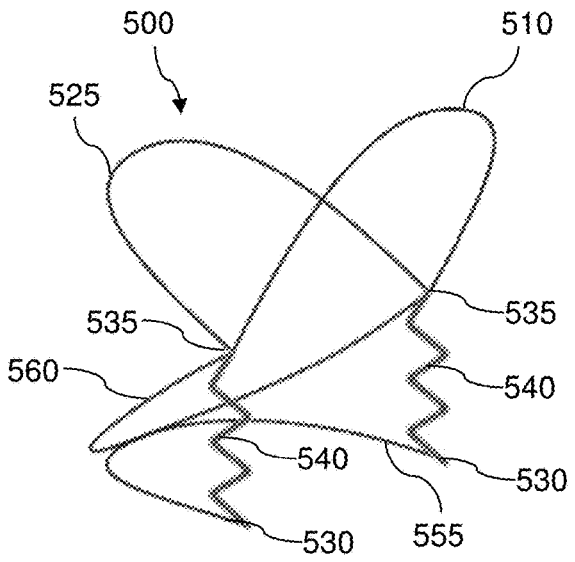
FIG. 5 represents, schematically, a fourth particular embodiment of the device that is the subject of the present invention.

In the embodiment shown in FIG. 5, at least one spreader of the device 500 comprises at least two arcs, 555 and 560, each support 530 and each articulation 535 being attached to the end of an arc.

Preferably, one arc 555 is attached to each support 530 and one arc 560 is attached to each articulation 535, the arcs being tangential to the middle of each arc, 555 and 560.

The "middle of each arc, 555 and 560" means here a portion of at least ten percent of the length of each arc, 555 and 560, around the middle of each arc 555 and 560.

Preferably, the arcs, 555 and 560, have the same shape and the same dimensions.

One arc, 555 or 560, is a bar, or a rod. The arc, 555 or 560, preferably has a circular or elliptical cross-section. The cross-section can be hollow. In the embodiment shown in FIG. 5, at least one spreader comprises at least one triangulation spacing means 540 between the two arcs, 555 and 560, for separating the ends of one arc 560 from the ends of the other arc 555.

It is noted that a triangulation spacing means is a spacing means in which at least two rods are attached to each other by means of a pivoting connection by one end and by a pivoting connection to moving parts by another end. The spacing of the moving parts causes the rotation of the rods forming two sides of a triangle, the dimension of the third side increasing, in the manner of an accordion. Several sets of rods can be positioned one after another.

Preferably, the fabric (not shown) covering the hoops, 510 and 525, covers the arcs, 555 and 560, as well.

Figure 6:
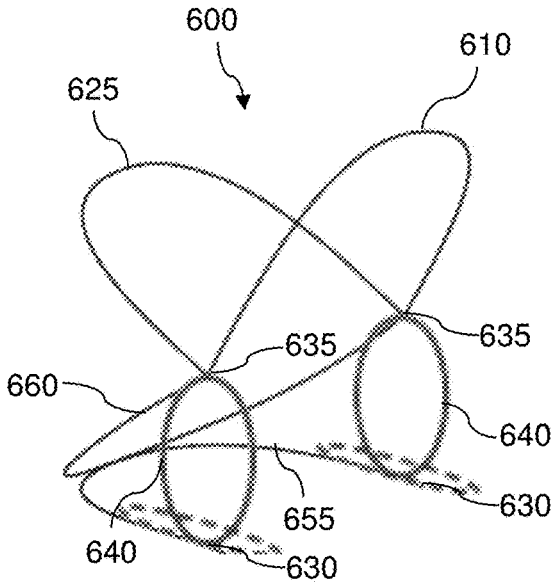
FIG. 6 represents, schematically, a fifth particular embodiment of the device that is the subject of the present invention.

In the embodiment shown in FIG. 6, at least one spreader comprises at least two arcs, 655 and 660, each support 630 and each articulation 635 being attached to the end of an arc.

Preferably, one arc 655 is attached to each support 630 and one arc 660 is attached to each articulation 635, the arcs being tangential to the middle of each arc, 655 and 660.

The "middle of each arc, 655 and 660" means here a portion of at least ten percent of the length of each arc, 655 and 660, around the middle of each arc 655 and 660.

Preferably, the arcs, 655 and 660, have the same shape and the same dimensions.

One arc, 655 or 660, is a bar, or a rod. The arc, 655 or 660, preferably has a circular or elliptical cross-section. The cross-section can be hollow. In the embodiment shown in FIG. 6, at least one spreader comprises at least one deformable part 640 tangential to one end of one arc 660 and one end of the other arc 655.

The deformable part has the properties of a spring in terms of elasticity. In the embodiment shown in FIG. 6, the deformable part has a closed curve shape, preferably a circle or an ellipse. The deformable part is configured to deploy the arcs, 655 and 660, automatically. To fold the spreader, the user brings the arcs together and deforms the deformable part 640.

Preferably, the device 600 comprises a retention means (not shown) for keeping the hoops, 610 and 625, and each spreader 640 in a position referred to as the "folded position" that minimizes the size of the device 600.

Preferably, the retention means can be a cord or elastic band to be wound around a support 630 and each arc, 655 and 660, and hoop, 610 and 625. In other embodiments, the retention means is a pocket located between the supports 630 with a substantially similar shape to that of the arcs, 655 and 660, and hoops, 610 and 625, fitted with a zip. The arcs, 655 and 660, the hoops, 610 and 625, and the fabric (not shown) are folded and placed in the pocket, which is then closed by means of the zip.

In the embodiments below, the retention means can be similar to the means described above.

Preferably, the fabric (not shown) covering the hoops, 610 and 625, covers the arcs, 655 and 660, as well.

Figure 7:
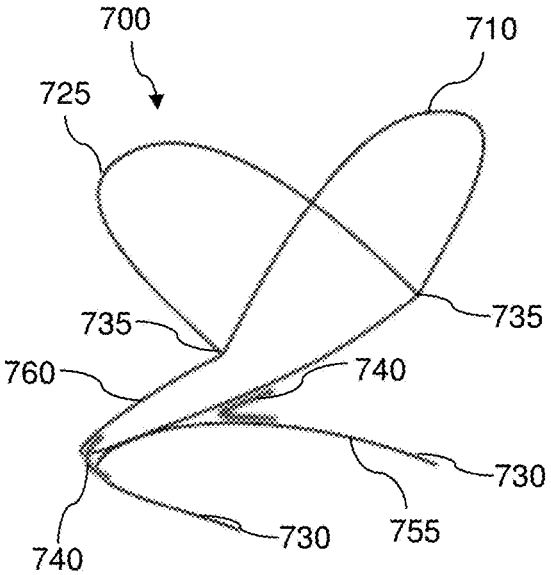
FIG. 7 represents, schematically, a sixth particular embodiment of the device that is the subject of the present invention.

In the embodiment shown in FIG. 7, at least one spreader comprises at least two arcs, 755 and 760, each support 730 and each articulation 735 being attached to the end of an arc.

Preferably, one arc 755 is attached to each support 730 and one arc 760 is attached to each articulation 735, the arcs being tangential to the middle of each arc, 755 and 760.

The "middle of each arc, 755 and 760" means here a portion of at least ten percent of the length of each arc, 755 and 760, around the middle of each arc 755 and 760.

Preferably, the arcs, 755 and 760, have the same shape and the same dimensions.

One arc, 655 or 660, is a bar, or a rod. The arc, 755 or 760, preferably has a circular or elliptical cross-section. The cross-section can be hollow. In the embodiment shown in FIG. 7, at least one spreader comprises at least one V-spring 740 close to the articulation 735 or the middle of the arcs.

A V-spring is a spring configured to maintain two tangential parts at a predefined angle, where the parts can be retractable by deforming the spring. A spring is known as a V-spring when the legs of the spring are separated in a manner substantially similar to the letter V.

The V-spring 740 resembles the arcs in the separated position. Preferably, the angle formed between a straight line passing through the middle of one arc and one end of the arc and a straight line passing through the middle of the other arc and one end of the other arc configured to be placed on the same side of the user's head is held by each V-spring 740 at an angle between fifteen and sixty degrees.

Preferably, each V-spring 740 is positioned close to the place where the arcs 755 and 760 are tangential on either side of said place.

In other embodiments, each V-spring is positioned between an articulation 735 and a support 730 configured to be placed on the same side of the user's head.

Preferably, the device 700 comprises a retention means (not shown) for keeping the hoops, 710 and 725, and each spreader 740 in a position referred to as the "folded position" that minimizes the size of the device 700.

Preferably, the fabric (not shown) covering the hoops, 710 and 725, covers the arcs, 755 and 760, as well.

Figure 8:
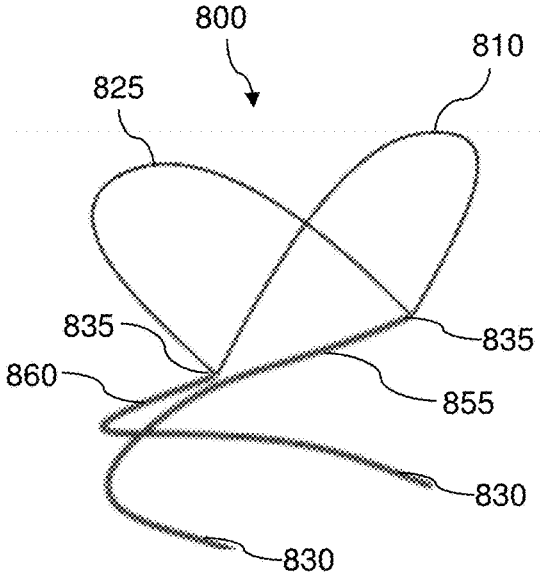
FIG. 8 represents, schematically, a seventh particular embodiment of the device that is the subject of the present invention.

In the embodiment shown in FIG. 8, at least one spreader comprises at least two arcs, 855 and 860, each support 830 and each articulation 835 being attached to the end of an arc.

Preferably, one arc 855 is attached to one support 830 and one articulation 835, and one arc 860 is attached to the other support 830 and the other articulation 835, the arcs crossing at the middle of each arc, 855 and 860.

Preferably, each arc, 855 and 860, has a helical shape. The arc 860 has a helix with a pitch that has the same distance and opposite direction to the pitch of the arc 855. In the embodiment shown, the pitch of the helix of the arc 860 is a left-hand pitch whereas the pitch of the helix of the arc 855 is a right-hand pitch. Each arc, 855 and 860, describes a half-pitch of the helix. The distance between each support 830 and each articulation 835 is defined by the pitch of the helix divided by two.

The helical arcs act like a spring and deploy the spreader automatically.

The "middle of each arc, 855 and 860" means here a portion of at least ten percent of the length of each arc, 855 and 860, around the middle of each arc 855 and 860.

Preferably, the device 800 comprises a retention means (not shown) for keeping the hoops, 810 and 825, and each spreader 840 in a position referred to as the "folded position" that minimizes the size of the device 800.

Preferably, the fabric (not shown) covering the hoops, 810 and 825, covers the arcs, 855 and 860, as well.

Figure 9:
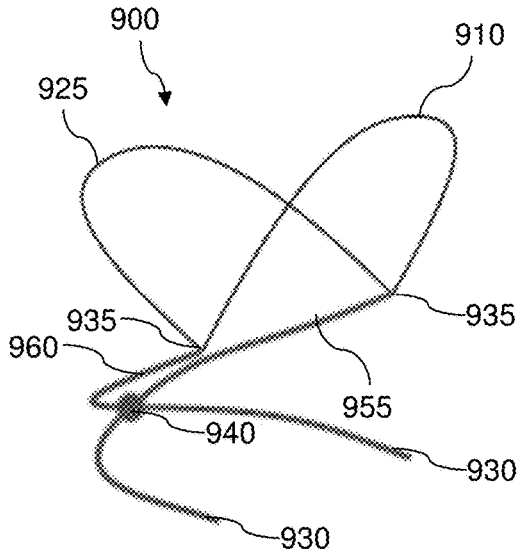
FIG. 9 represents, schematically, an eighth particular embodiment of the device that is the subject of the present invention.

The embodiment shown in FIG. 9 shows a subsidiary embodiment of the embodiment shown in FIG. 8, showing a device 900 having hoops 910 and 925, in which the arcs are assembled by means of a toothed assembly 940.

The toothed assembly 940 governs the pivoting connection between the arcs, 955 and 960, which has the same attributes as the embodiment 800.

The toothed assembly comprises a predefined number of teeth defining positions between the arcs, 955 and 960. The toothed assembly forms a pivoting connection between the arcs, 955 and 960, with an axis perpendicular to the axis of the arcs, 955 and 960, at the middle of the arcs, 955 and 960. The toothed assembly is a toothed pivoting connection whose utilization is known to the person skilled in the art.

Figure 10:
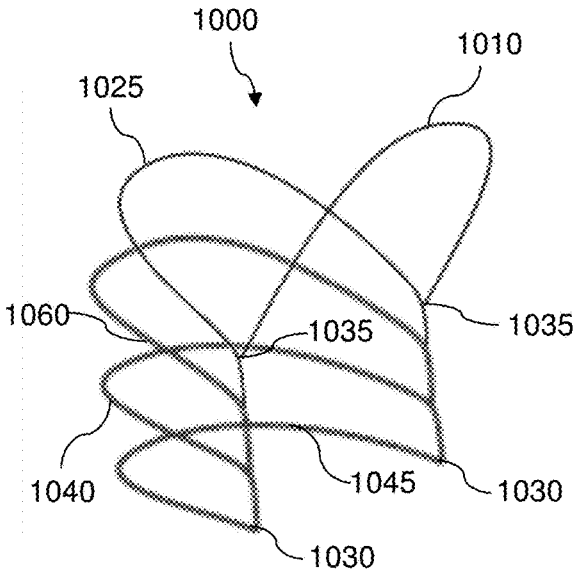
FIG. 10 represents, schematically, a ninth particular embodiment of the device that is the subject of the present invention.

FIG. 10 shows a particular embodiment of the device 1000 in which at least one spreader comprises two sliding parts, 1040, 1045 and 1060, a first part, 1045, being attached to the supports 1030 and a second part 1060 being attached to the articulations 1035.

Each part comprises a frame, 1040, 1045 or 1060. The frame 1045 referred to as the "bottom frame" has an arc shape, i.e. semi-circular or semi-elliptical, between the supports 1030, the arc being configured to pass behind the user's head. The frame 1040 referred to as the "middle frame" has two substantially rectilinear portions between each support 1030 and each articulation 1045 configured to be placed on the same side of the user's head as said support 1030, and one portion having an arc shape. The frame 1060 referred to as the "top frame" has two substantially rectilinear portions between each support 1030 and each articulation 1045 configured to be placed on the same side of the user's head as said support 1030, and one portion having an arc shape.

The substantially rectilinear portions of the middle frame 1040 and the frame 1060 slide. For example, each substantially rectilinear portion of the middle frame 1040 comprises a concave relief into which a substantially rectilinear portion of the top frame is inserted, the portions sliding by forming a sliding connection.

In the embodiments 3 to 10, the arcs and a sheet of fabric covering the space around the arcs comprise the base.

Figure 11:
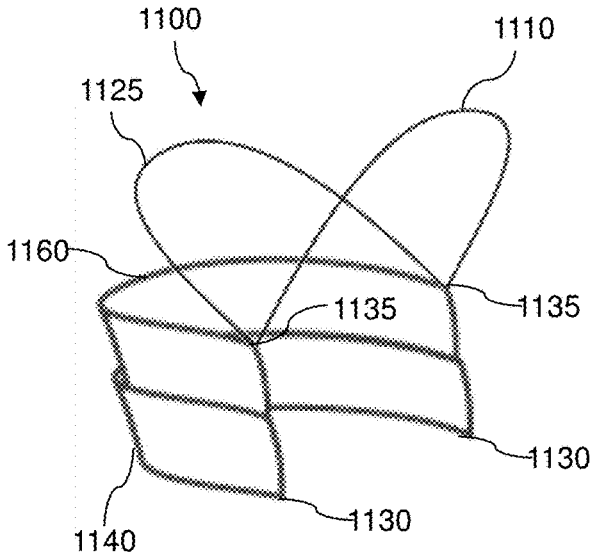
FIG. 11 represents, schematically, a tenth particular embodiment of the device that is the subject of the present invention.

FIG. 11 shows a particular embodiment of the device 1100 having a pair of hoops 1110 and 1125 in which at least one spreader comprises two sliding parts 1140 and 1160, a first part, 1140, being attached to the supports 1130 and a second part 1160 being attached to the articulations 1135.

Preferably, the first part 1140 has a V-shaped cross-section in which the second part 1160 slides, in the form of a sliding connection.

Preferably, the rigidity of the materials provides the sliding connection. Preferably, each part is a compressed foam or plastic panel. Preferably, each part is lined and/or covered by fabric.

Figure 12:
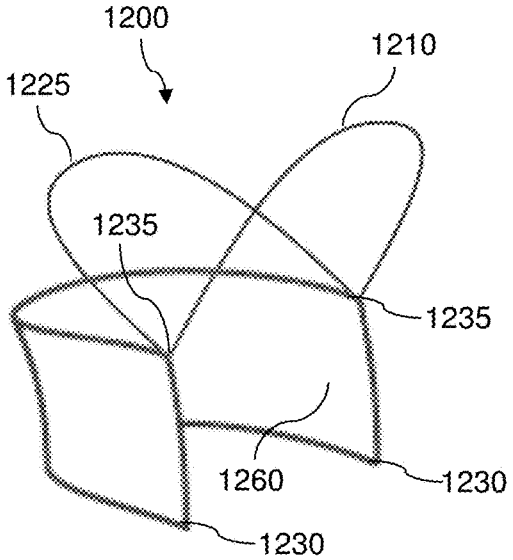
FIG. 12 represents, schematically, an eleventh particular embodiment of the device that is the subject of the present invention.

FIG. 12 shows a particular embodiment of the device 1200 having a pair of hoops 1210 and 1225 in which the spreader 1260 and the base are one and the same and said spreader has a predefined size and shape. Preferably, the spreader 1260, when laid flat, has a rectangular shape or widens from the center in a "butterfly" shape, and has a half-cylinder shape once attached to the supports 1230 and the articulations 1235.

It is noted that a cylinder is a surface in space defined by a straight line, called the generatrix, passing through a variable point describing a closed flat curve, called the guide curve, and maintaining a fixed direction.

Figure 13:
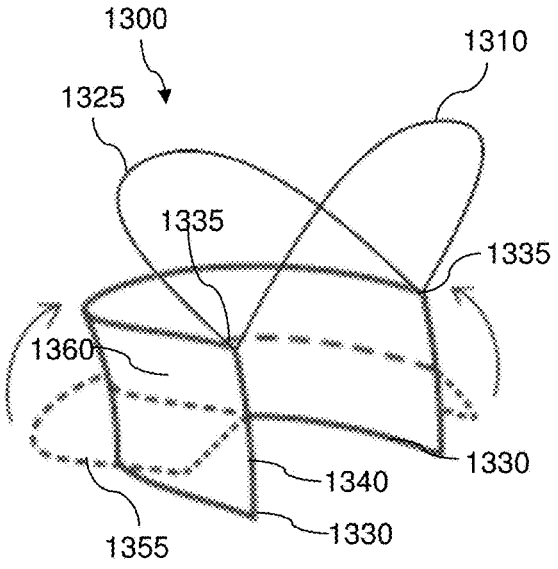
FIG. 13 represents, schematically, a twelfth particular embodiment of the device that is the subject of the present invention.

The guide curve is a circle or ellipse, and the generatrix only follows a portion of the guide curve, preferably half. FIG. 13 shows an embodiment 1300 similar to the embodiment in FIG. 12 having a pair of hoops 1310 and 1325 in which the spreader 1360 and the base are one and the same, and said spreader comprises a prefabricated fold. The prefabricated fold is preferably in the middle of the spreader from one shoulder to the other.

In the embodiment 1300 at least one spreader 1360 comprises one foldable portion attached to the articulations 1360 and one attached portion 1340 comprising the supports.

The foldable portion 1360 is shown in an intermediate folding position 1355.

Figure 14:
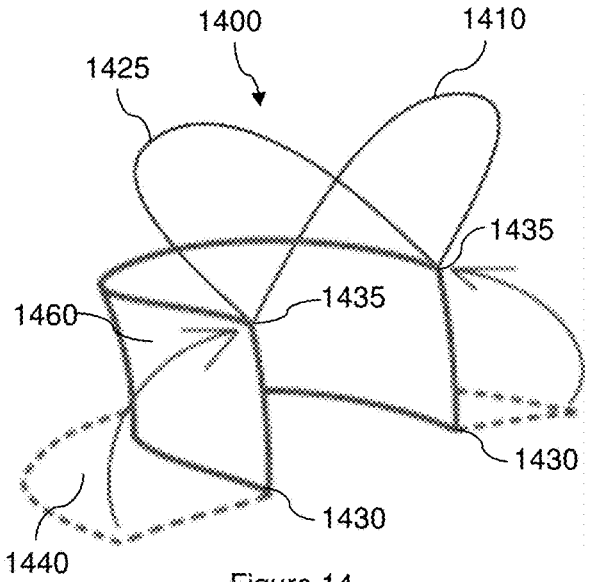
FIG. 14 represents, schematically, a thirteenth particular embodiment of the device that is the subject of the present invention.

FIG. 14 shows a particular embodiment of the device 1400 having a pair of hoops 1410 and 1425, articulations 1435 and a foldable portion 1460.

The embodiment shown in FIG. 14 is similar to the embodiment shown in FIG. 13 in which the prefabricated fold is located on the perimeter of the base next to the user's shoulders when the device 1400 is worn by the user.

Figure 15:
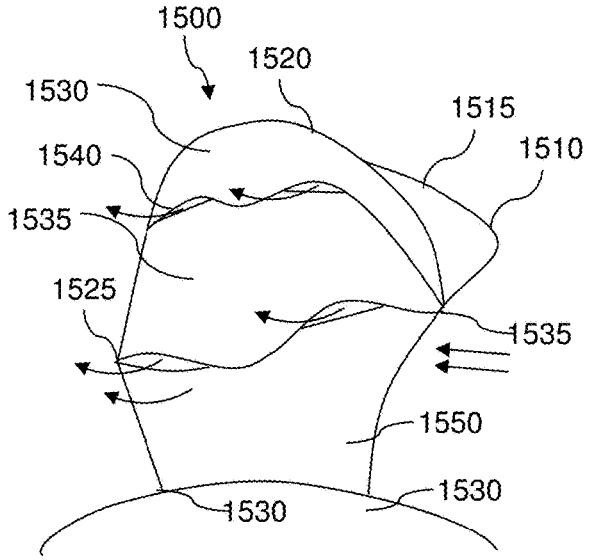
FIG. 15 represents, schematically, a fourteenth particular embodiment of the device that is the subject of the present invention.

FIG. 15 shows an embodiment of the device 1500 in which the device 1500 comprises ventilation elements. The ventilation elements 1540 shown in FIG. 15 can be adapted to any embodiment described above or below.

FIG. 15, which is not to scale, shows a schematic view of an embodiment of the device 1500 that is the subject of the present invention.

The retractable protection device 1500 for protecting a user's head from bad weather comprises:

- at least one hoop, 1510, 1520 and 1525;
- at least two articulations 1535 of at least one hoop 1510 with a base 1550, each articulation 1535 being attached to one end of at least one hoop 1510, at least one articulation 1535 comprising a means for locking said hoop 1510 in a predefined position referred to as the "deployed position";
- an at least partially closed base 1550, configured to surround the user's nape at least partially, comprising:
  - at least one support 1530 resting on each shoulder of the user; and
  - at least one spreader (not shown) for positioning each articulation 1535 at a predefined distance from each support 1530 in the deployed position;
- a sheet of fabric, 1515, 1530 and 1535, attached to each hoop, 1510, 1520, 1525, and the base 1550 to create a protection screen around the user's head in the deployed position, the fabric and hoops being circumscribed by the base in a position referred to as the "folded position" that minimizes the size of the device, between the user's nape and shoulders, freeing up the user's back.

The hoops, 1510, 1520 and 1525, the supports 1530, the articulations 1535 and the spreaders and the base 1550 are similar to the embodiments described with reference to FIGS. 1 to 14.

The fabric, 1515, 1530 and 1535, has a ventilation element 1540 at the location of at least one hoop, 1510, 1520 or 1525. The ventilation element 1540 is produced by creating an opening in the fabric 1515, 1530 or 1535. The opening is such that the fabric 1535 on one side of the hoop 1520, for example, ends without covering a hoop 1520, and the fabric 1530 on the other side of the hoop 1520 covers the hoop and the opening 1540. More generally, the sheet of fabric comprises an opening and another piece of fabric is superimposed on the opening without being attached around the opening, so that the wind can lift the other piece of fabric.

Therefore, when the wind blows into the device 1500 around the user's face, the portion of the fabric 1530 covering the hole lifts up and lets the blowing air escape. The portion of fabric 1530 uncovers a ventilation element 1540 oriented towards the user's nape such that rain falling on the fabric 1530 runs off to the outside of the device 1500 without discomforting the user.

Figure 16:
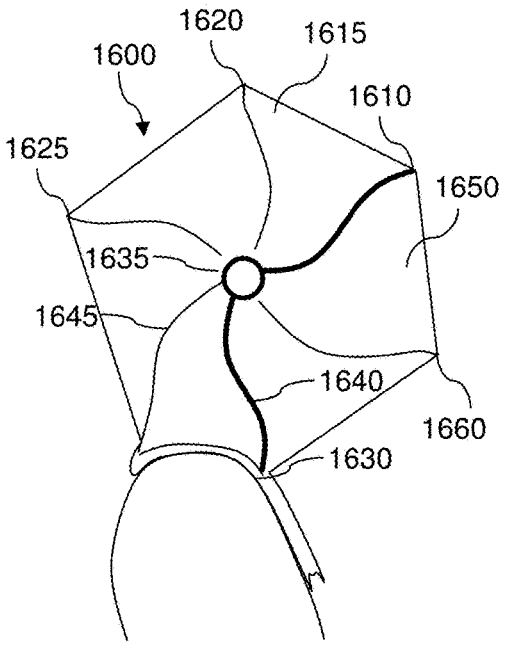
FIG. 16 represents, schematically, a fifteenth particular embodiment of the device that is the subject of the present invention.

FIG. 16 shows a particular embodiment of the device 1600 which comprises an additional middle hoop 1660 compared to the devices described with reference to FIGS. 1 to 15, for supporting a visor or insect screen, for example. The device 1600 includes a sheet of fabric 1615, hoops 1610 and 1620 and articulation 1635.

The middle hoop 1660 can be deployed in front of the user's face after the deployment of the front hoop 1610. The fabric 1650 between the front hoop 1610 and the additional middle hoop 1660 lets the wavelengths visible to the human eye pass. The fabric 1650 can be made of a transparent material or can be an insect screen, for example.

The hoop 1660 has the same characteristics as the middle hoops described above.

The fabric 1650 can extend from the front hoop 1610, over the additional middle hoop 1660, to the spreaders 1640 and supports 1630. The fabric 1650 can be attached to the spreaders and supports, for example by means of a zip, to prevent insects from entering.

In some embodiments, the fabric 1650 is equipped with at least one screen for projecting augmented reality information, for example. The information transmitted can be information about a historic monument during a guided visit, the names on the peaks during a mountain hike, the location of screws for disassembling an industrial apparatus, for example.

In some embodiments, an augmented reality screen is attached to the device 1600 by a retractable arm, which can also be attached on the equipment, for example at the location of the articulation.

In some embodiments, the fabric 1650 is a filter for dust or fine particulate pollutants.

The embodiment in FIG. 17 shows an embodiment of the device 1700 that is the subject of the present invention, having a hoop 1720 and articulation 1735, in which the fabric, 1715 and 1740, comprises a cape 1740 to protect at least the user's shoulders. The cape 1740 is dimensioned to protect at least the user's shoulders. The cape 1740 can be dimensioned to protect the user from the head to the ankles.

The rain cape 1740 can be added as an accessory, in the form of a U-shaped "sausage" attached to the base in a bag or pocket, for example by means of a zip or press-studs. The sausage has a zip which, once open, allows the rain cape to be unrolled.

The rain cape 1740 can also be packed away in a closable pack specially created for this in the base.

Figure 18:
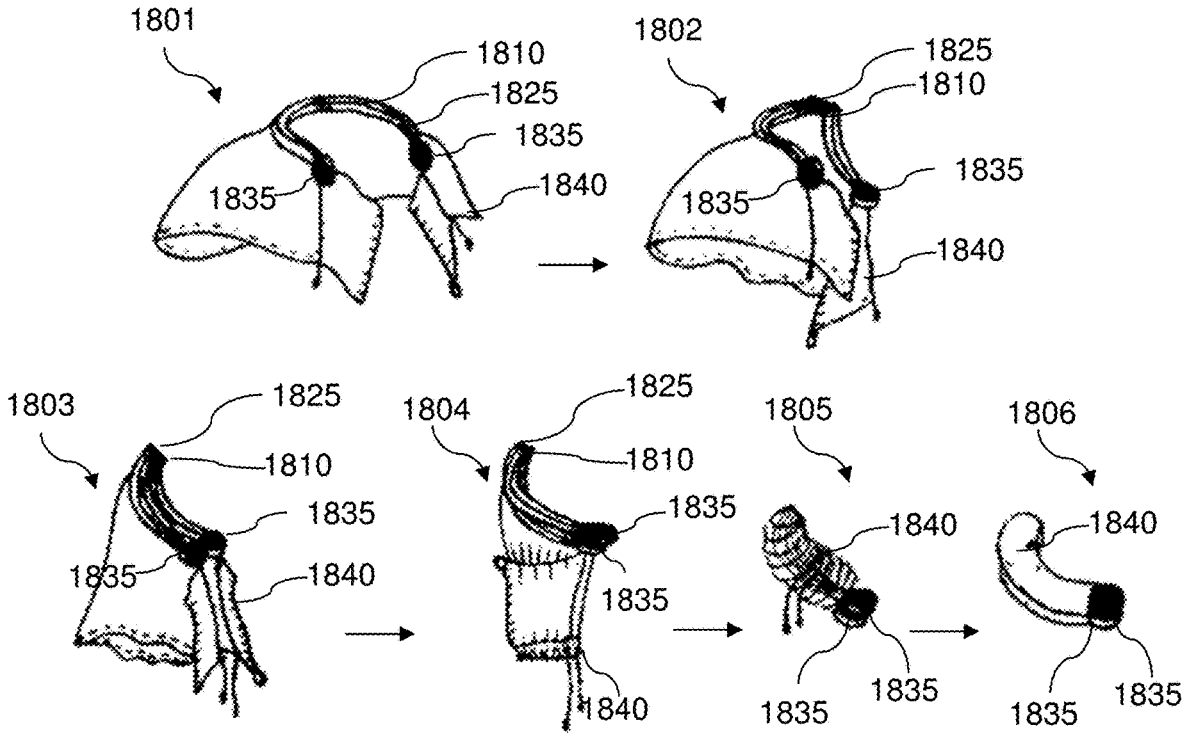
FIG. 18 represents, schematically, the steps in a particular embodiment of a method of folding a particular embodiment of the device that is the subject of the present invention.

FIG. 18 shows different steps in folding an invention embodiment. The invention embodiment shown in FIG. 18 comprises a cape 1840 and a spreader embodiment described above.

The step 1801 shows the hoops, 1810 and 1825, folded on the location where the user positions his nape and his shoulders. This spreader is folded and the articulations 1835 are located close to the supports. In some embodiments, the hoops, 1810 and 1825, are rolled up on themselves.

During the step 1802, the hoops, 1810 and 1825, are folded substantially in their middle so that the articulations 1835 are substantially juxtaposed in position 1803.

During the step 1804, the cape is wrapped around the folded hoops, 1810 and 1825.

During the step 1805, cords linked to the articulations 1835 or to the cape 1840 are wrapped around the cape and a knot is made to keep the assembly compact.

During the step 1806, a bag is placed around the compact assembly.

Figure 19:
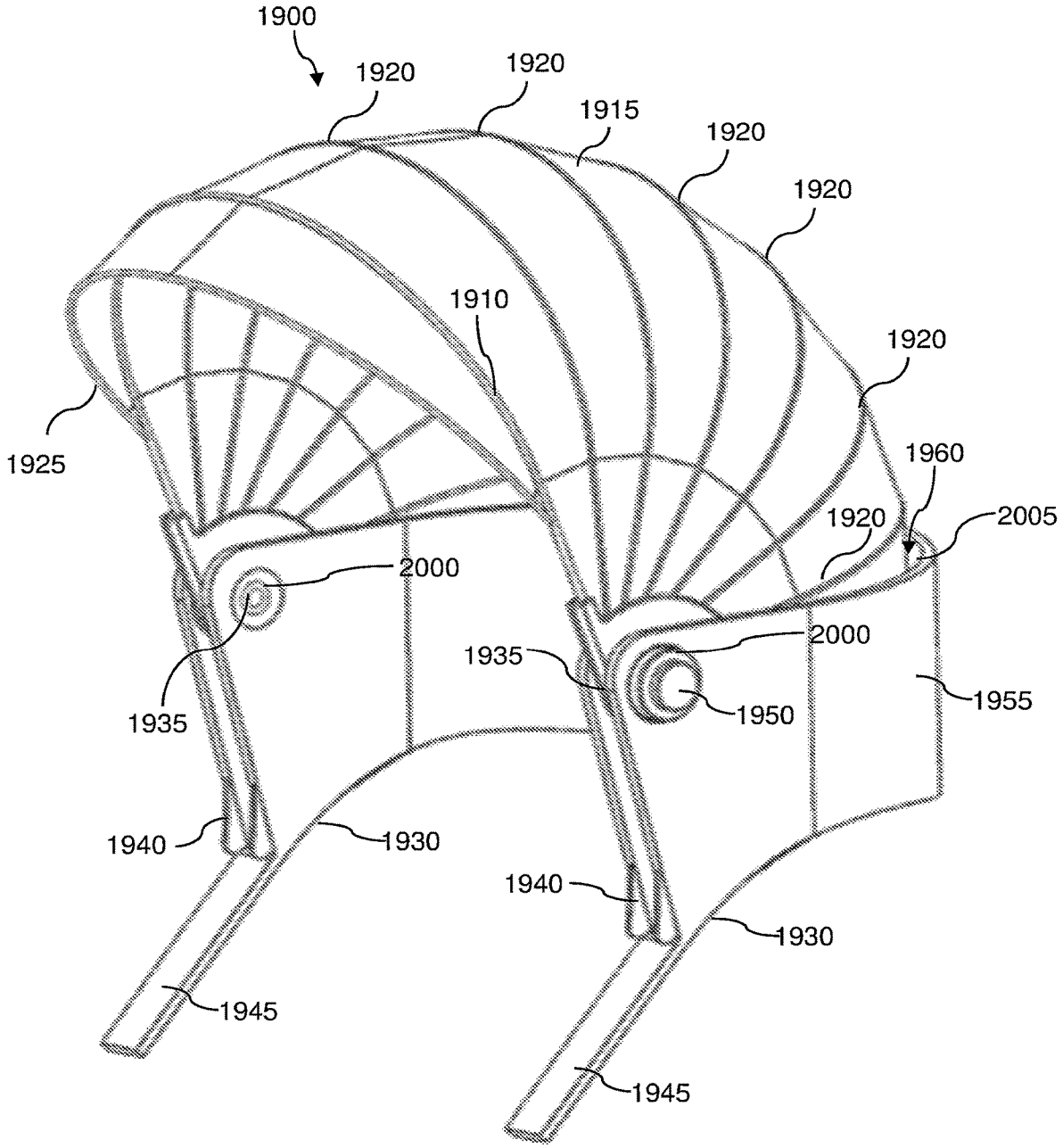
FIG. 19 represents, schematically, a seventeenth particular embodiment of the device that is the subject of the present invention.

FIG. 19, which is not to scale, shows a schematic view of an embodiment of the device 1900 that is the subject of the present invention.

The retractable protection device 1900 for protecting a user's head from environmental elements comprises:

at least one hoop 1910;

at least two articulations 1935 of at least one hoop 1910 with a base 1955, each articulation 1935 being attached to one end of at least one hoop 1910, at least one articulation 1935 comprising a locking means 1950 for locking said hoop 1910 in a predefined position referred to as the "deployed position";

an at least partially closed base 1955, configured to surround the user's nape at least partially, comprising: at least one support 1930 resting on each shoulder of the user; and at least one spreader 1940 for positioning each articulation 1935 at a predefined distance from each support 1930 in the deployed position;

a sheet of fabric 1915 attached to each hoop, 1910 and 1920, and the base 1955 to create a protection screen around the user's head in the deployed position, the fabric and hoops being circumscribed by the base in a position referred to as the "folded position" that minimizes the size of the device, between the user's nape and shoulders, freeing up the user's back.

The protection device 1900 comprises one hoop 1910, referred to as the "front hoop", positioned above and in front of the user's face in the deployed position. In the embodiment shown in FIG. 1, the device comprises six hoops 1920, referred to as "middle hoops", between the front hoop 1910 and the base 1955. The description of the front hoop 1910 and middle hoops 1920 matches the description given with reference to FIG. 1.

In some embodiments, the device 1900 comprises a cap attached to at least one hoop. For example, the front hoop 1910 comprises an ancillary hoop 1925 articulated with the front hoop 1910 above the articulations 1935 further away from the base 1955. The ancillary hoop is connected to the front hoop 1910 by the fabric 1915 forming a cap. In another embodiment, the front hoop comprises two ancillary hoops, so as the cap can be deployed in two positions, providing more or less additional protection.

The front hoop 1910 is attached to an articulation 1935. The articulation 1935 forms a pivoting connection between the front hoop 1910 and the base 1955.

Preferably, each articulation 1935 comprises:

at least two fasteners for fastening to the base 1955, the fasteners forming a pivoting connection axis;

one part, mobile in rotation around the pivoting connection axis, comprising a longitudinal hole matching the shape of the end of a hoop 1910, in which the end of at least one hoop 1910 is placed, and having an axis perpendicular to the pivoting connection axis.

Preferably, the fasteners for fastening to the base 1955 are embedded in the base 1955 and form the supports 1930.

In some embodiments, the articulation 1935 comprises a return spring in the deployed position.

Each articulation 1935 comprises a locking means 1950. The locking means 1950 can be any locking means known to the person skilled in the art, such as the insertion of a retractable pin into a corresponding hole, for example. The locking means 1950 can be released by means of a push-button, for example.

Preferably, the articulation 1935 comprises a system of teeth known to the person skilled in the art, blocking the rotation of the articulation 1935.

Preferably, one articulation 1935 is located at one of the user's ears, and the other articulation 135 is at the level of the user's other ear in the deployed position.

In some embodiments (not shown), the articulation 1935 is equipped with a cord connected to the front hoop 1910. By pulling on the cord, the user deploys the front hoop 1910 above the user's head to the desired position.

In some embodiments, the articulation 1935 is hollowed out at the location of the axis of rotation of the articulation 1935. The cut-out allows an accessory to be inserted, for example an additional middle hoop such as the hoop 1660 shown in FIG. 16, or an electronic device.

Preferably, the supports 1930 are part of a base 1955 forming a collar resting around the user's nape and shoulders. The base 1955 is preferably a pre-cut and preformed part made of foam covered with fabric. The preform comprises a fold, the fold positioned on the user's shoulder forms each support 1930 and the articulation is placed between each face of the fold. Preferably, the fabric 1915 is attached by sewing, or by any other means that can be detached, such as a zip or press-studs, on the face farthest from the user's nape, between the faces, i.e. on the inside of the fold.

In the embodiment shown in FIG. 19, the base 1955 comprises a piece of material or fabric 1945 attached to an item of clothing or a clothing accessory. The piece of material or fabric 1945 can be lined with foam to protect the user's shoulders.

Preferably, the base 1955 comprises a retention means for keeping the hoops in a position referred to as the "folded position" that minimizes the size of the device. Preferably, the retention means has a pocket 1960 fitted with a closure means 2005 attached to at least one fastener 2000 attaching the fabric 1915 to the base 1955, the pocket 1960 being positioned in the base 1955.

Preferably, the pocket 1960 is made of a similar material to the fabric 1915.

Preferably, the pocket 1960 is placed between the faces of the fold forming the base 1955. The pocket 1960 extends substantially from one 1935 to the next. The fold forming the base creates the pocket 1960 on the interior of the fold defined by each face of the fold. Preferably, a zip, or any other detachable means such as press-studs, forms the closure means 2005 of the pocket 1960 and is also attached by sewing in the same place as or close to the place where the fabric 1915 is attached to the base 1955.

The fabric 1915 and/or the fabric of the base 1955 are preferably made of a material resistant to impacts, tears and ultraviolet, such as polyester, polypropylene, or polyamide.

In some embodiments, the fabric 1915 and/or the fabric of the base 1955 are made of an impermeable material.

In some embodiments, the fabric 1915 and/or the fabric of the base 1955 are made of a lined material to protect the user from the cold. In some embodiments, the fabric 1915 comprises at least one portion made of a material reflecting light or incorporating a light device so that the user is more visible in the dark, especially when the device 1900 is lit up by headlights.

In some embodiments, the base 1955 comprises an attachment means configured to:

- attach the device 1900 to at least one backpack strap, for example the attachment means is a hook-and-loop fastener type of material positioned around the backpack strap;
- attach the device 1900 to a harness or a holster; and/or
- attach the device 1900 to an item of clothing or a clothing accessory, for example by means of clips or press-studs.

In some embodiments, the device 1900 comprises a harness (not shown). The harness can comprise two adjustable straps that pass under the user's arms. In some embodiments, the harness comprises an adjustable strap slung over the shoulder. In some embodiments, the harness is in the form of a holster or vest. In some embodiments, the harness comprises shoulder straps that are 10 to 30 millimeters thick. In some embodiments, the harness comprises a piece of fabric comprising press-studs or hook-and-loop fastener strips to be attached to an item of clothing or a clothing accessory. The item of clothing or clothing accessory can comprise additional attachment means.

The following embodiments are additional embodiments suitable for the embodiments of FIGS. 1 to 19 described above.

A wireless audio system, for example Bluetooth (registered trademark), can be incorporated into the device. The audio system can comprise loudspeakers housed in the articulations, for example. The loudspeakers broadcast the sound from an audio device such as a portable communicating terminal or a smartphone of the user. The audio system can comprise a microphone housed close to the supports, for example. The audio system can be an embedded hands-free telephone system. In some embodiments, the front hoop, a support or an articulation, comprises a camera or a photo camera.

In some embodiments, the device is equipped with at least one sensor incorporated into the fabric, articulations, supports and/or hoops. The sensor can be a temperature, humidity, light, UV exposure, motion, acceleration or fall, sound, odor or video sensor, or a geolocation device. The device therefore makes it possible to record and share routes taken, follow an exercise program, share photos of panoramas, the presence of a particular animal whose cry has been recognized, for example.

In some embodiments, the fabric incorporates a flexible solar photovoltaic film enabling the electrical autonomy of the embedded electronic equipment, with or without a built-in battery, or making it possible to charge small electronic devices, such as an accumulator, smartphone, video camera, lamp or geolocation system. In some embodiments, the fabric has a photovoltaic nature, for example by using photovoltaic paint or using a photovoltaic fabric.

In some embodiments, the fabric comprises a device for recovering and converting the user's heat into energy.

In some embodiments, the device is equipped with a light-emitting diode ("LED") lighting system. The lighting system can be night lighting and/or comprise traffic lights such as indicator and brake lights, for use by cyclists for example. The lighting system can be controlled electronically by an acceleration sensor located, for example, in an articulation. The lighting system can be the fabric itself, in which lighting or illumination elements have been inserted.

In some embodiments, the fabric of the device is warming or cooling.

In some embodiments, the fabric of the device includes an odoriferous system or a system for vaporizing a liquid, e.g. water, or a gas, e.g. oxygen, in front of the user's face, for the user's well-being or for the user's safety against a hazardous gas or dust projection, for example.

In some embodiments, the base can accommodate, on its lower surface or in its lower portion, a part (made of perforated foam, for example) that is 10 to 30 millimeters thick. This part makes it possible to raise the position of the base relative to the user's shoulders, and thus to raise the position of the articulations in order to adjust the size of the device to the user's measurements (height of his head and/or his neck).

In some embodiments, each hoop is a rigid segment, for example made of compressed foam or rigid fabric. The hoops are nested together when the hood is folded, like the shell of the pangolin, for example. In some embodiments, the segments comprise seals enabling support and hermeticity between the segments.

The invention claimed is:

1. A retractable protection device for protecting a user's head against environmental elements, comprising:

- a base configured to extend between the user's shoulders and the user's nape, and to surround the user's nape, said base includes at least one support configured to rest on each shoulder of the user;
- at least one hoop;

at least two articulations for pivoting connection of said at least one hoop with said base, each articulation being attached to one end of said at least one hoop, at least one articulation comprising a means for locking said at least one hoop in a predefined position referred to as the "deployed position"; and a sheet of fabric attached to said at least one hoop and the base to create a protection screen around the user's head in the deployed position;

wherein said base includes at least one spreader for positioning, in the deployed position, each articulation at a predefined distance from said at least one support above the user's shoulders; and wherein said base, in a position referred to as the "folded position", is configured to circumscribe the sheet of fabric and said at least one hoop such that the sheet of fabric and said at least one hoop are contained, between the user's nape and shoulders, entirely freeing up the user's back in the folded and in the deployed position.

2. The device according to claim 1, which comprises a retention means for keeping said at least one hoop in the folded position.

3. The device according to claim 2, wherein the retention means has a pocket fitted with a closure means attached to at least one fastener attaching the fabric to the base, the pocket being positioned in the base.

4. The device according to claim 1, wherein the at least one spreader comprises a first arc and a second arc, and wherein said at least one support is attached to an end of the first arc and each articulation is attached to an end of the second arc.

5. The device according to claim 4, wherein said at least one spreader comprises a first strut and a second strut, articulated to one another by a toothed rotation means and wherein said at least one support is attached to an end of the first strut, and one of said at least two articulations is attached to an end of the second strut.

6. The device according to claim 4, wherein the first and second arcs cross and are assembled by means of a toothed assembly.

7. The device according to claim 4, wherein the first and second arcs being tangential to one another at a middle section thereof.

8. The device according to claim 4, wherein the at least one spreader comprises at least one triangulation spacing means between the first arc and the second arc for separating the end of the first arc from the end of the second arc.

9. The device according to claim 4, wherein at the least one spreader comprises at least one deformable part tangential to the end of the first arc and to the end of the second arc.

10. The device according to claim 1, wherein the at least one spreader comprises at least two sliding parts, a first part being attached to the at least one support and a second part being attached to the at least two articulations.

11. The device according to claim 1, wherein the at least one spreader comprises one portion attached to the at least two articulations and one foldable portion comprising the at least one support.

12. The device according claim 1, wherein the sheet of fabric comprises a cape to protect at least the user's shoulders.

13. The device according to claim 1, which comprises means for attaching the device to clothing or a clothing accessory.

14. The device according to claim 1, which comprises a cap attached to said at least one hoop.

15. The device according to claim 1, wherein the at least two articulations comprise a means for attaching at least one accessory.

* * * * *